US005195511A

United States Patent [19]

Kodato et al.

[11] Patent Number: 5,195,511

[45] Date of Patent: Mar. 23, 1993

[54] BUBBLE MASSAGER

[75] Inventors: Toshiharu Kodato; Kozo Tamura; Tomotaka Honda; Toshihiro Takahashi; Masaki Kaji, all of Hitachi; Shoichi Ito, Ibaraki, all of Japan

[73] Assignees: Hitachi, Ltd., Tokyo; Ihitachi Taga Technology, Ltd., Ibataki, both of Japan

[21] Appl. No.: 640,212

[22] Filed: Jan. 11, 1991

[30] Foreign Application Priority Data

Jan. 19, 1990 [JP] Japan ..... 2-008257
Jan. 19, 1990 [JP] Japan ..... 2-008258

[51] Int. Cl.[5] ..... A61H 9/00
[52] U.S. Cl. ..... 128/66
[58] Field of Search ..... 128/24.1, 65, 66; 4/491, 492, 541, 542, 544; 30/42

[56] References Cited

U.S. PATENT DOCUMENTS 3,587,976 6/1971 Jacuzzi ..... 128/66 X
4,100,917 7/1978 Talge et al. ..... 128/66
4,594,777 6/1986 Kimoto et al. ..... 30/42
4,742,584 5/1988 Abe ..... 4/542
4,774,934 10/1988 Hara ..... 128/66
4,942,871 7/1990 Hara ..... 4/492 X
4,991,568 2/1991 Lin ..... 128/44 X

*Primary Examiner*—Mickey Yu
*Assistant Examiner*—Brian E. Hanlow
*Attorney, Agent, or Firm*—Antonelli, Terry, Stout & Kraus

[57] ABSTRACT

The present invention relates to a bubble massager used in a bathtub in which a rechargeable storage battery is used as a power supply, One display unit for displaying both a charging state and an operating state is provided. It is possible to discharge and select three types of bubble jets, weak, strong and intermittent, and to display an operating mode. Futhermore, it is possible to display a trouble location of the bubble massager by high-speed flickering of the one display unit. Moreover, the bubble massager constructed so that the jet is controlled so as to be discharged in the order of weak→strong→intermittent and the intermittent jet is made to repeat strong ⟷ feeble jet for providing an uninterrupted jet in order to relieve a shock due to a sensible sudden change caused by change over of the bubble jet.

6 Claims, 16 Drawing Sheets

FIG. 9

| | STATUS | WEAK DISPLAY LAMP | STRONG DISPLAY LAMP | INTERMITTENT DISPLAY LAMP |
|---|---|---|---|---|
| OPERATION | (a) WEAK OPERATING MODE | ○ | | |
| | (b) STRONG OPERATING MODE | | ○ | |
| | (c) INTERMITTENT OPERATING MODE | | | ○ |
| | (c) INTERMITTENT OPERATING MODE (STORAGE BATTERY VOLTAGE DROP) | | | ⊘ FLICKERING |
| CHARGING | START → $V_1$ | ○ | | |
| | $V_1$ → $T_2$ | | ○ | |
| | $T_2$ → END | | | ○ |

MARK ○: LIGHTING

FIG. 10

| MODE | TROUBLE LOCATION | WEAK DISPLAY LAMP | STRONG DISPLAY LAMP | INTERMITTENT DISPLAY LAMP |
|---|---|---|---|---|
| CHARGING | TRIAC(TR1) SHORT - CIRCUIT | ⊘ | | |
| | PHOTOCOUPLER(PC1) OPENED | | ⊘ | |
| | PHOTOCOUPLER(PC1)SHORT-CIRCUIT | | | ⊘ |
| | TRANSISTOR(Q1) OPENED | ⊘ | ⊘ | |
| | TRANSISTOR(Q1) SHORT-CIRCUIT | ⊘ | | ⊘ |
| OPERATION | TRANSISTOR(Q2) OPENED | | ⊘ | ⊘ |
| | MOTOR LOCK | ⊘ | ⊘ | ⊘ |

MARK ⊘ : HIGH-SPEED FLICKERING

BUBBLE MASSAGER

BACKGROUND OF THE INVENTION

The present invention relates to a bubble massager used in a bathtub in which a rechargeable storage battery is used as a power source and a display portion which displays a charging state and an operating state is provided, and more particularly to a bubble massager which is able to discharge and select three types of bubble jets and to display an operating mode.

Conventionally, in some electronic devices each including a storage battery as a power source such as a bubble massager, a charge quantity in a storage battery has been estimated by measuring a terminal voltage of a storage battery or by counting accumulated time of charging time and operating time, and has been displayed as a charged quantity and a discharged quantity of a storage battery of a bubble massager and the like using a display unit. For example, a rechargeable shaver and the like may be mentioned as an example. However, there has been no rechargeable shaver which also displays an operating state. On the other hand, some devices having a plurality of operating modes display an operating mode and an operating time, etc. As an example, an electronic rice cooking jar which displays "rice cooking", "double heating", "steaming" and the like using lamps such as LEDs may be mentioned. In conventional electronic devices, however, a display portion has been used for a single use only for the most part in such a manner that a unit which displays charging is used for charging display only and a unit which displays operation is used for operation display only. Further, some devices in which a charger for charging a storage battery in a main device body is provided separately from the main body have display units in the charger and the main unit, respectively, in such a manner that a display portion which displays a charging state is provided on the charger side and a display portion which displays an operating state is provided on the main body side. Incidentally, JP-A-59-151959 may be mentioned as an example of this type of device.

This device relates to a bubbling unit in a bath, in which sealing performance between a storage battery and a control circuit is improved and a space inside a main body is utilized to the utmost by covering the storage battery and the control circuit in a main body containing a motor, a storage battery, a control circuit, a centrifugal pump and an air intake pipe for fresh-air inlet with resin formed by thermal deposition, respectively.

In the prior art described above, however, there has been no chargeable device which displays a plurality of functions displaying both a charging state and an operating state at the time of operation. Further, a charging state and an operating state have been displayed with separate display portions. As a result, when both the charging state and the operating state are displayed with one set of unit, a charge display portion and an operation display portion have to be provided separately. Therefore, an area occupied by display portions is widened, restriction in point of design is increased and the number of components is increased. Thus, there has been a fear of causing increase in cost and lowering in reliability.

Furthermore, conventional bubble massagers have only one type of bubble jet and has been impossible to select and use a jet which meets a part and a state of a body.

Namely, in the prior art described above, no consideration has been given to type and selection of bubble jets, i.e. a jet (injection pressure) which meets a part and a state of a body (stiffness, myalgia and the like), but only a fixed jet is supplied, and thus it is not possible to select a jet which meets a part and a state of a body.

SUMMARY OF THE INVENTION

It is a principal object of the present invention to provide a rechargeable bubble massager in which an area occupied by a display portion in a product is narrow, and both a charging state display and an operating state display can be provided with a small number of components.

It is another object of the present invention to control discharging of a jet which meets a part and a state of a body and to enable a user to select the jet freely.

It is still another object of the present invention to display an operating mode of a jet which has been selected for use by a user.

It is still another object of the present invention to display troubles by using the same display means used for the display of the charging state and the operating state.

In order to achieve the above-described objects, the charging state display portion and the operating state display portion of a bubble massager are used in common so as to display both with the same display unit.

The same display unit which displays both the charging state and the operating state is provided in a main body of a rechargeable bubble massager, and a control portion using a microcomputer and the like detects that charging is performed from the outside at the time of charging and sends a signal displaying the charging state to the display portion. Further, the control portion judges similarly to the above that the operation has been started and sends a signal displaying the operating state to the display portion at the time of operation. By using the same display portion for a charging state display during charging and for an operating state display during operation as described above, the construction of the display portion is simplified and only a small occupied area is required, cost reduction and reliability improvement may be expected, restriction in point of appearance design is reduced, and designing also becomes easy.

Furthermore, discharging of three types of jets, weak, strong and intermittent (pulsation), is controlled, and is made selectable with one pushbutton switch on the main body. Moreover, a control system in which the jet is discharged in the order of weak→strong→intermittent has been adopted in order to relieve a shock caused by a sensible sudden change due to jet changeover. Further, a system in which the intermittent jet is made to repeat in the order of strong ⟷ feeble so that the jet is not interrupted by repeating strong ⟷ feeble jets for the intermittent jet is adopted so as to relieve the stress at the time of starting a motor and reduce a starting current. Furthermore, in order to display the operating mode of the jet described above, optical guides are provided which are made non-contacting with display lamps (LEDs) on a substrate of the main body and wet-sealable with a case which encloses the substrate of the main body.

Discharging of three types of jets, weak, strong and intermittent, is controlled so as to make it possible to select a jet in succession in the order of weak → strong → intermittent (repetition of strong ⟷ feeble) with one pushbutton switch on the main body. With this, it becomes possible to use a jet in accordance with a part and a state of a body, and it is also possible to relieve a shock due to a sensible sudden change by starting from the weak jet. Further, the intermittent operation is performed by repeating strong ⟷ feeble thereby not to interrupt the jet. Namely, it is intended to relieve the stress at the time of starting the motor and reduce the starting current by keeping the motor running.

Furthermore, in order to display an operating mode of the jet, optical guides are provided which are made non-contacting with display lamps (LEDs) on a substrate of a main body and wet-sealable to a case enclosing the substrate of the main body.

BRIEF DESCRIPTION OF THE DRAWINGS

Preferred embodiments of the present invention will now be described in conjunction with the accompanying drawings, in which:

FIG. 1 through FIG. 9 show a first embodiment of the present invention, and more particularly:

FIG. 1 is a side view showing a bubble massager according to the present invention in use;

FIG. 2 is a longitudinal sectional view showing a first embodiment of a bubble massager according to the present invention;

FIG. 3 is a left side view taken along a direction III—III shown in FIG. 2;

FIG. 4 is a circuit block diagram of a first embodiment of the present invention;

FIG. 5 is a longitudinal sectional view of a charger and a connector shown in FIG. 4;

FIG. 6 is a graph showing a terminal voltage and a charging current at the time of charging a storage battery in the present invention;

FIG. 7 shows diagrams of motor drive output signal waveforms which are output from an indication control portion at the time o operation;

FIG. 8 is a flow chart of the action at the time of operation;

FIG. 9 is a table showing display examples on the display portion in an operating state and a charging state;

FIG. 10 shows a second embodiment of the present invention, in which display examples on the display portion are shown;

FIG. 11 is a sectional view from a front of a main body construction of a third embodiment of the present invention;

FIG. 12 is a sectional view from the side in a direction XII—XII shown in FIG. 11;

FIG. 13 is a sectional view from the side in a direction XIII—XIII shown in FIG. 11;

FIG. 14 is a sketch drawing of the main body of the third embodiment of the present invention;

FIG. 15A through FIG. 15D are drawings showing a lighting state of a display lamp and a jet state in the third embodiment of the present invention, respectively;

FIG. 16 is an enlarged sectional view of a display lamp portion used in the third embodiment of the present invention; and FIG. 17 is a control circuit diagram used in the third embodiment of the present invention.

DESCRIPTION OF THE PREFERRED EMBODIMENTS

A first embodiment of a bubble massager of the present invention will be described hereinafter with reference to the drawings.

Figure 1:
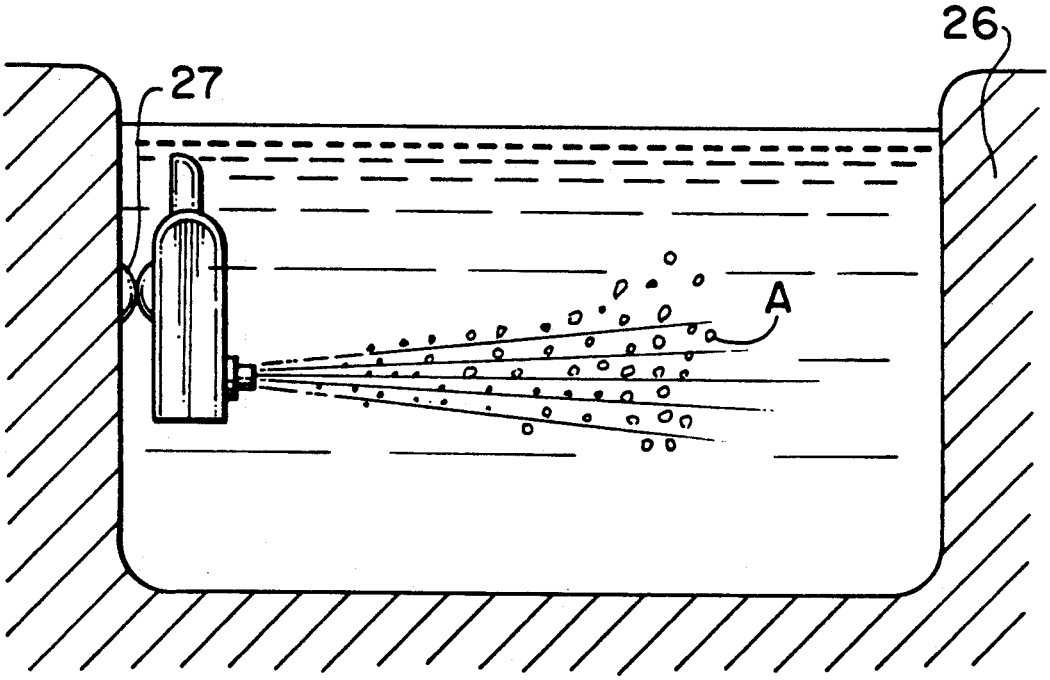
Figure 2:
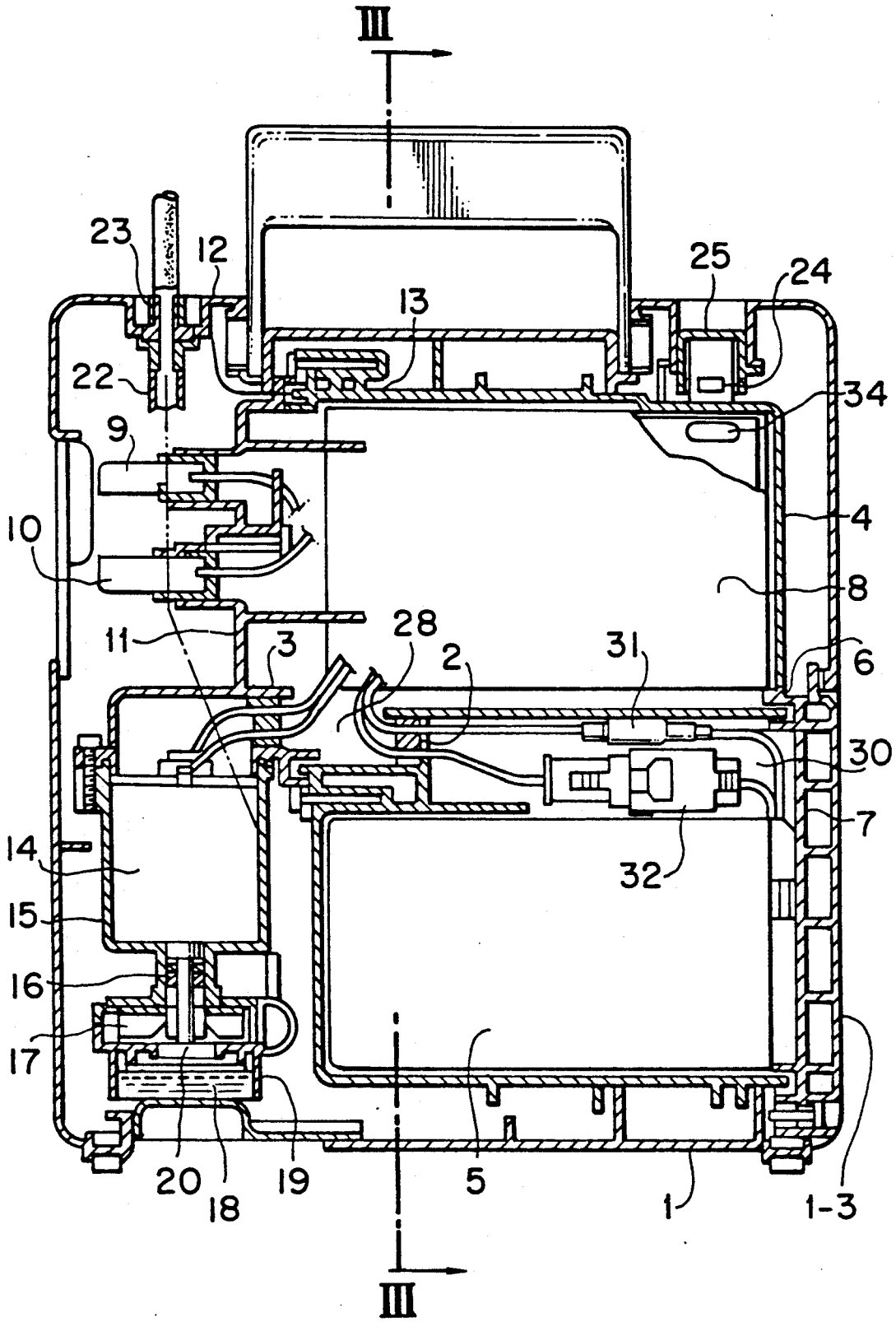
Figure 3:
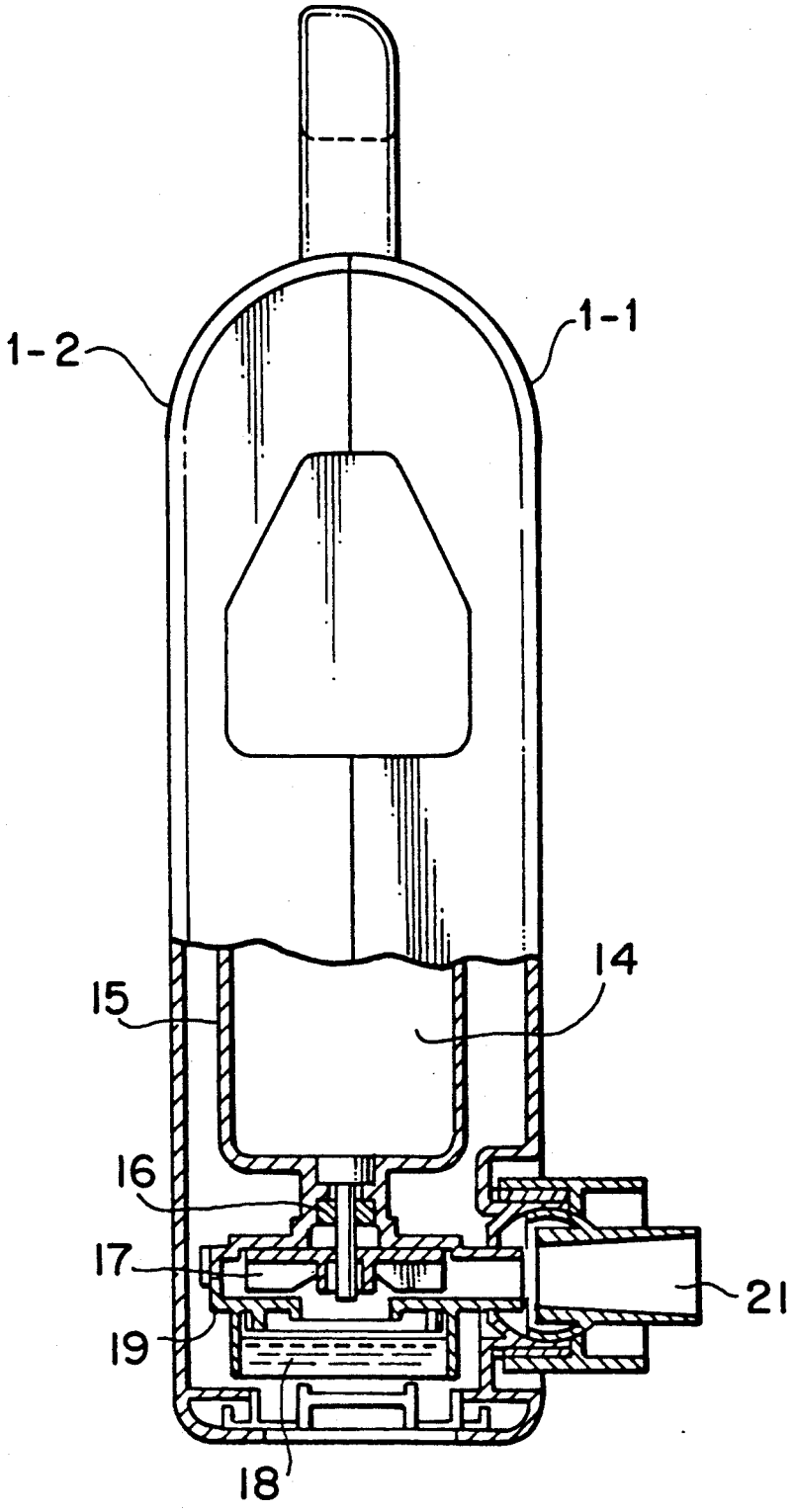

FIG. 1 is a side view showing a bubble massager according to the present invention in use, FIG. 2 is a longitudinal sectional view of a first embodiment of a bubble massager according to the present invention, and FIG. 3 is a left side view in a direction III—III shown in FIG. 2.

The embodiment according to the present invention is a bubble massager used in a bathtub 26 as shown in FIG. 1.

In FIG. 2 and FIG. 3, an inner case 4 which is separated into chambers on upper and lower stages by lead wire packings 2 and 3 is provided inside a main body case 1 consisting of a front case 1-1, a rear case 1-2 and a battery cap 1-3. A storage battery 5 is housed in the lower chamber, which is wet-sealed by a rubber packing 6 and enclosed by a storage battery cover 7, and a control device is housed in the upper chamber, which is wet-sealed and enclosed with a circuit cover 11 provided with terminals 9 and 10 for charging the storage battery 5 and a rubber packing 12, thereby to form an air chamber 13. Furthermore, a motor case 15 provided with a motor 14 for a pump is fitted, and the inner case 4 is sealed from the outside. Under the motor case 15, an impeller 17 which is wet-sealed with an oil seal 16 and rotated by the motor 14 for a pump is fitted, and forms a centrifugal pump portion 20 together with a pump cover 19 provided with a filter 18. One end of an air intake pipe 22 which introduces air from the outside is connected to an exhaust nozzle 21 of the pump portion 20, and another end of the air intake pipe 22 is connected to an air intake fitting 23 provided on the main body case 1, thus forming a principal part. Further, a pushbutton 25 containing a magnet 24 inside thereof is provided in the main body case 1 so that a reed switch 34 provided on a printed substrate in the air chamber 13 may be put ON and OFF.

The present embodiment is either installed in the bathtub 26 by a suction cup 27 and the like as shown in FIG. 1 or used by hand by a user. At this time, one end of the air intake pipe 22 is placed outside the bathtub so as to suck in air. When the button 25 is pushed in this state, the magnet 24 closes the reed switch 34, electric power is supplied from the storage battery 5 and the motor 14 for the pump is rotated. Thus, the impeller 17 suctions water and discharges water from the exhaust nozzle 21 of the pump portion 20. At this time, air is suctioned by the jet from the pump portion 20 thereby to form a negative pressure, and discharged as a bubble flow A, thus producing a massage effect, a caloric effect that warms a body so as not to feel a chill after a bath, a cleaning effect and so forth.

Figure 4:
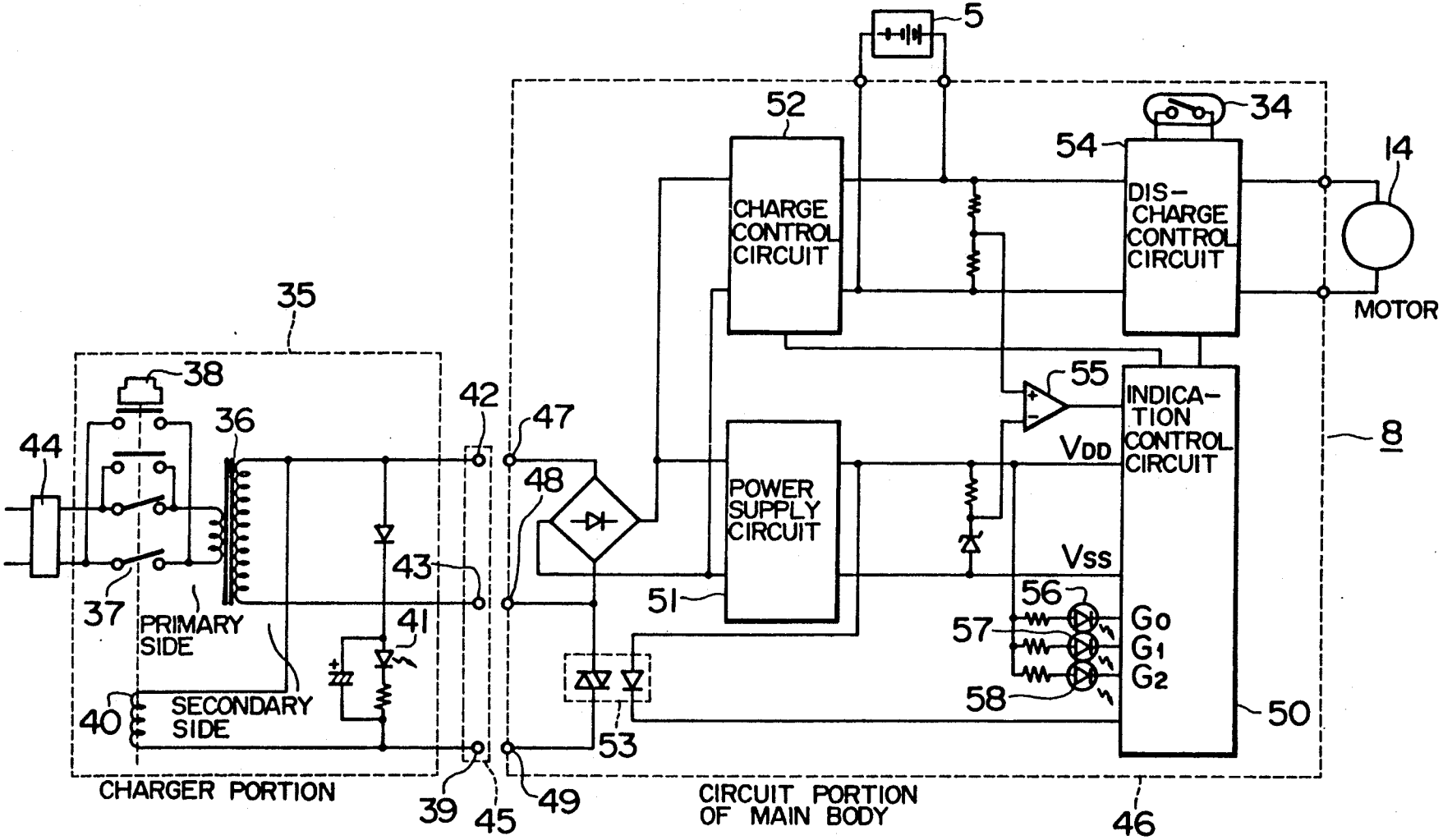

Next, FIG. 4 shows a circuit block diagram of a first embodiment of the present invention. The circuit consists broadly of a charger portion 35 and a circuit portion 46 of a main body. In the charger portion 35, a transformer 36 is included, a relay contact 37 is connected to the primary side of the transformer 36, a pushbutton switch 38 is provided so that the relay contact 37 may be short-circuited, and further, a relay coil 40 connected to a secondary side of the transformer 36 and a control connecting terminal 39 of a line way, a light emitting diode 41 for display which is connected in series with the relay coil 40 and is ON while an electric current is applied to the relay coil 40 and a pair of connecting terminals 42 and 43 which supply the secondary current of the transformer 36 to the outside are connected thus forming a principal part. Further a power supply plug 44 connected to the primary side of the transformer 36 and a connector 45 containing connecting terminals 39, 42 and 43 are provided outside the charger portion 35. In a main body circuit portion 46, connecting terminals 47 and 48 which can be connected to the secondary side of the transformer 36 of the charger portion 35 and a connecting terminal 49 which is connected to a connecting terminal 39 for controlling the line way are provided, and further, an indication control portion 50 using a microcomputer and the like which controls charge and discharge states of the storage battery 5 and the operation of the motor 14 for the pump, a power supply circuit 51 which supplies electric power to the indication control portion 50, a charge control circuit 52 which controls charging of the storage battery 5, a reed switch 34 for starting and stopping the motor 14 for the pump, a discharge control circuit 54 which controls the operation of the motor 14 for the pump, a phototriac 53 which controls an ON-OFF operation of the relay coil 40 in the charger portion 35 and a comparator 55 which compares the terminal voltage of the storage battery 5 with a reference voltage and sends a signal to the indication control portion 50 are connected thereby to form a principal part.

Figure 5:
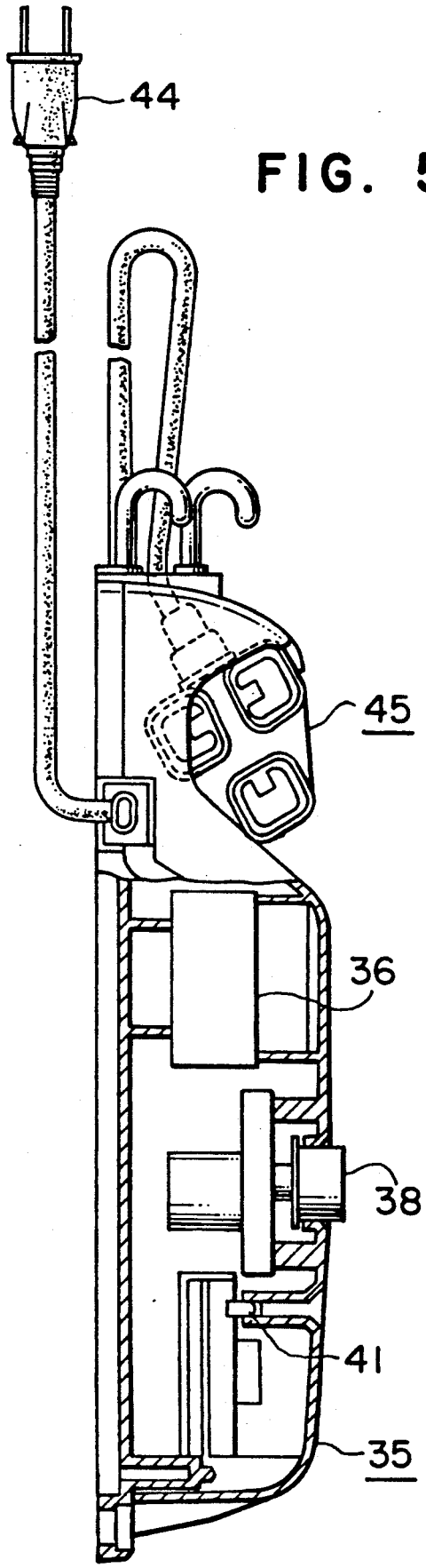

FIG. 5 shows a longitudinal sectional view of a charger portion and a connector shown in FIG. 4.

Next, the operation of charging the storage battery 5 will be described.

In FIG. 4 and FIG. 5, power the supply plug 44 of the charger portion 35 is connected to a commercial power supply, and the connector 45 is connected with the main body when the storage battery 5 is charged. When the pushbutton switch 38 of the charger portion 35 is pushed under the state described above, the commercial power supply is fed to the primary side of the transformer 36 and an output voltage is generated on the secondary side of the transformer 36. This output voltage is supplied to the main body circuit portion 46 through the connector 45, and a DC voltage required for the operation of the indication control portion 50 and so forth is produced in and supplied by the power supply circuit 51. The indication control portion 50 which is supplied with electric power required for the operation thereof brings the phototriac 53 into a conducting state. As a result, the relay coil 40 of the charger portion 35 is excited and the relay contact 37 is brought into an ON state from an OFF state. Thus, the commercial power supply is continued to be applied to the primary side of the transformer 36 even if the pushbutton switch 38 is released. The storage battery 5 is charged in this state. When charging is completed, the indication control portion 50 brings the phototriac 53 into a non-conducting state. With this, current application to the relay coil 40 of the charger portion 35 is suspended, the relay contact 37 is brought into a OFF state, and the commercial power supply is stopped being supplied to the primary side of the transformer 36 thus completing the charging operation.

Figure 6:
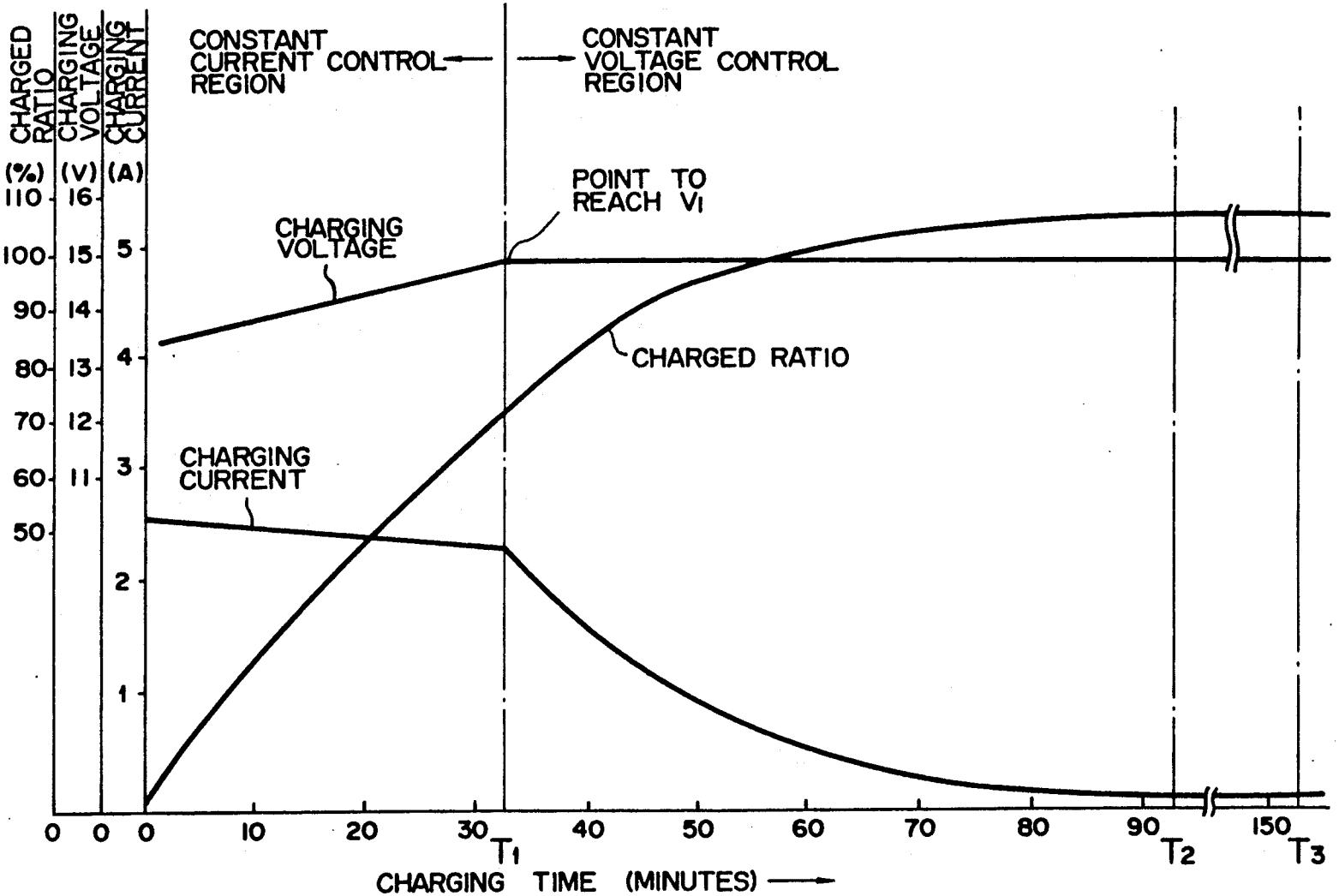

Next, FIG. 6 shows a graph showing a terminal voltage, a charging current and charged quantity of a storage battery when the storage battery 5 is charged. A constant current charging in which the charging current of the storage battery 5 becomes almost constant after starting charging is conducted. As charging progresses, the terminal voltage of the storage battery rises gradually. When the terminal voltage of the storage battery reaches a predetermined set voltage $V_1$ at the charging time $T_1$, additional charging is performed while performing constant voltage control so that the terminal voltage of the storage battery remains constant at $V_1$ during the charging time $T_1$ to $T_2$. The timing of the charging time $T_1$ to $T_2$ is obtained by means of a timer. If the atmospheric temperature is low at the time of charging, however additional charging is performed at a higher temperature than usual since the chemical reaction inside the storage battery 5 is slow. To be more precise, control is made so that the quantity of electricity of the storage battery 5 becomes constant without being affected by the atmospheric temperature by altering the set voltage $V_1$ depending on the atmospheric temperature at the time of charging. When charging is shifted to charging by constant voltage control, the charging current is reduced abruptly. The charged quantity is increased from 70% to 110% during the additional charging period by constant voltage control. In case the quantity of electricity of the storage battery 5 before starting to charge is large the terminal voltage of the storage battery reaches $V_1$ in short period of time, but, in case the quantity of electricity of the storage battery 5 before starting to charge is small, it takes a long time until the terminal voltage of the storage battery reaches $V_1$. Accordingly, it is possible to know the quantity of electricity of the storage battery 5 before starting to charge by measuring the time required for the terminal voltage of the storage battery to reach $V_1$ from starting to charge.

Next, the operating mode of a bubbling device in a bath will be described.

Figure 7:
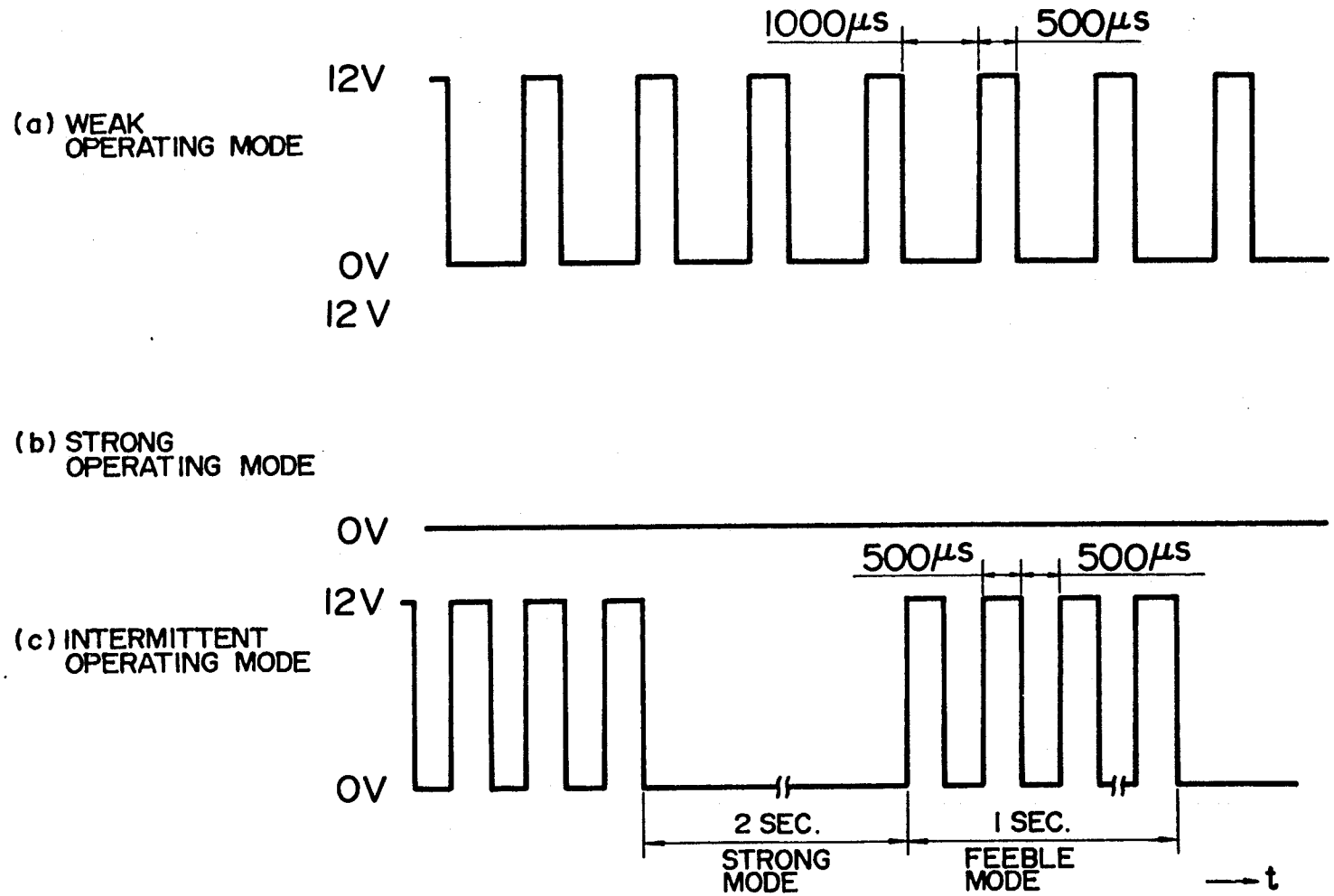
Figure 8:
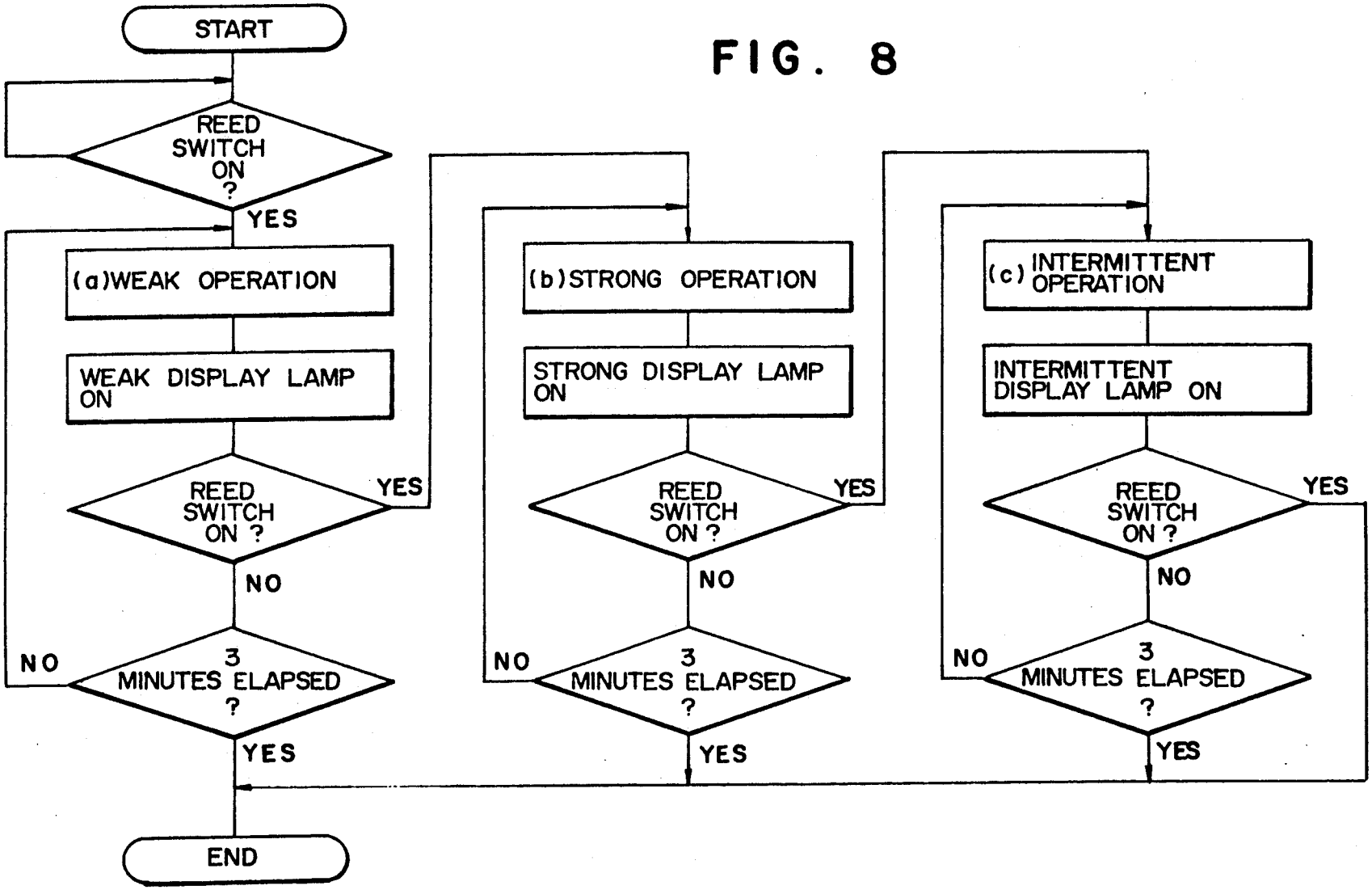

In FIG. 2, a bubt ling device in a bath starts operation in such a manner that the magnet 24 brings the reed switch 34 into an ON state when the pushbutton 25 provided on the main body is pushed, electric power of the storage battery 5 is supplied to the indication control portion 50 with the above, and the indication control portion 50 supplies the electric power of the storage battery 5 to the motor 14. Once the reed switch 34 is pushed, a three-minute timer in the indication control portion 50 is operated considering the practical application state. Unless a stop signal is applied to the indication control portion 50 from the reed switch 34 thereafter, operation is continued for three minutes and is automatically stopped after the lapse of three minutes after starting. Further, a semiconductor switching element (not shown) such as a power MOSFET which turns the connection of the storage battery 5 and the motor 14 ON and OF in accordance with a signal from the indication control portion 50 is provided in a discharge control circuit 54 of the main body circuit portion 46. There are three types of signals as shown in FIG. 7 for the signals which are sent to the power MOSFET from the indication control portion 50, and those signals correspond to (a) weak, (b) strong and (c) intermittent operation modes, respectively. In other words, 500 μs Low and 1,000 μs Hi signals are sent continuously from the indication control portion 50 to the power MOSFET for (a) weak mode, and the motor 14 is operated in the weak mode. In (b) strong mode, a Low signal is output continuously from the indication control portion 50, the motor 14 is in an ON state continuously and is operated in the strong mode. Further, (c) intermittent mode is an intermittent mode in which the motor 14 is operated in a strong mode of continuously ON for two seconds and a state of operation for one second in a feeble mode in which 500 μs Low and 500 μs Hi are repeated. These three operating modes can be selected by pushing the pushbutton 25 so as to turn the reed switch 34 ON. When the reed switch 34 is turned ON in a state that the bubbling device in a bath is stopped, operation is started in the weak mode, the weak mode is changed from the weak mode to the strong mode when the reed switch 34 is turned ON again, the strong mode is shifted to the intermittent mode when the reed switch 34 is turned ON for the third time, and the operation is stopped when the reed switch 34 is turned ON for the fourth time. The operating state of the bubbling device in a bath is shown with a flow chart in FIG. 8.

Next, the methods of showing states at the time of charging and at the time of operation will be specifically described.

Three display lamps are provided in the main body of the bubbling device in a bath as shown in FI. 9. They are a weak display lamp 56, a strong display lamp 57 and an intermittent display lamp 58 as shown in FIG. 4. Light emitting diodes (LEDs) and the like are used for these display lamps. As shown in FIG. 4, limiting resistors are provided between $V_{DD}$ (DC 5V) and cathodes of the respective display lamps. On the other hand, anode sides thereof are connected to ports $G_0$, $G_1$ and $G_2$ of the indication control portion 50. When the ports $G_0$, $G_1$ and $G_2$ of the indication control portion 50 present a Low state in a state that $V_{DD}$ is at 5 V, a lamp connected to a port which becomes Low is turned on. At the time of operation, a display lamp corresponding to a selected operating mode is ON. At the time of charging, the three display lamps display a progressing status of the charging. That is to say, the weak display lamp 56 is turned on simultaneously with starting. Then, when charging of the storage battery 5 progresses and the terminal voltage of the storage battery reaches the set voltage $V_1$, the weak display lamp 56 is turned off and the strong display lamp 57 is turned on. Thereafter, charging by constant voltage control is performed for a fixed time. When an intermediate point $T_2$ (FIG. 6) of the charging time by constant voltage control is reached, the strong display lamp 57 is turned off and the intermittent display lamp 58 is turned on. When charging progresses further and the time $T_3$ when charging by constant voltage control is completed is reached, all the display lamps are turned off.

When charging is performed again in an almost fully charged state for the storage battery 5, it happens sometimes that the terminal voltage of the storage battery 5 has already reached the set voltage $V_1$ at the time of starting to charge. In this case, the three display lamps are turned on at the same time after the lapse of five minutes after starting to charge, and the display lamps are turned off immediately thereafter, thus terminating charging.

As another embodiment of lighting a display lamp at the time of charging, it may be arranged so that none of the display lamps are turned on until the terminal voltage of the storage battery 5 reaches the set voltage $V_1$ from the start of charging, but all three display lamps are turned on when $V_1$ is reached, thus performing charging by constant voltage control. This is suited for displaying to a user that the device is usable by turning all three display lamps ON because charging of the storage battery 5 has reached an almost fully charged state when the terminal voltage of the storage battery 5 reaches $V_1$ and there is no specific problem in a practical application even if charging by constant voltage control is not performed thereafter.

A method of using an operating state display portion and a charging state display portion commonly has been described above, but it is also possible to use the display portion commonly for another purpose. As shown in a second embodiment of the present invention in FIG. 10, when parts composing a circuit break down thus making it possible to continue operation during charging or operation, the indication control portion 50 determines the defective parts from a trouble phenomenon and displays the determined result by having the three display lamps of the display portion flicker at a high speed. The reason why the lamps are made to flicker at a high speed is to notify a user distinctly of the trouble and to enable the user to distinguish the operation clearly from a normal operation. Further, it is an object of displaying a trouble location using the display portion as described above to enable a service person who repairs the trouble to find out the trouble location easily and to repair the trouble in a short period of time. When a motor locking trouble occurs, the trouble is not only displayed with the display portion, but receipt of operation commands by means of the reed switch 34 is prohibited for a certain period of time. This is for preventing breakdown of other electronic components and melting of a protective fuse from occurring when electric current is applied frequently to the motor by the reed switch 34 when the motor is locked because a locked current five times and more as large as an ordinary current is applied to a motor drive circuit when the motor is locked.

Next, a third embodiment of a bubble massager according to the present invention will be described with reference to the drawings.

Figure 11:
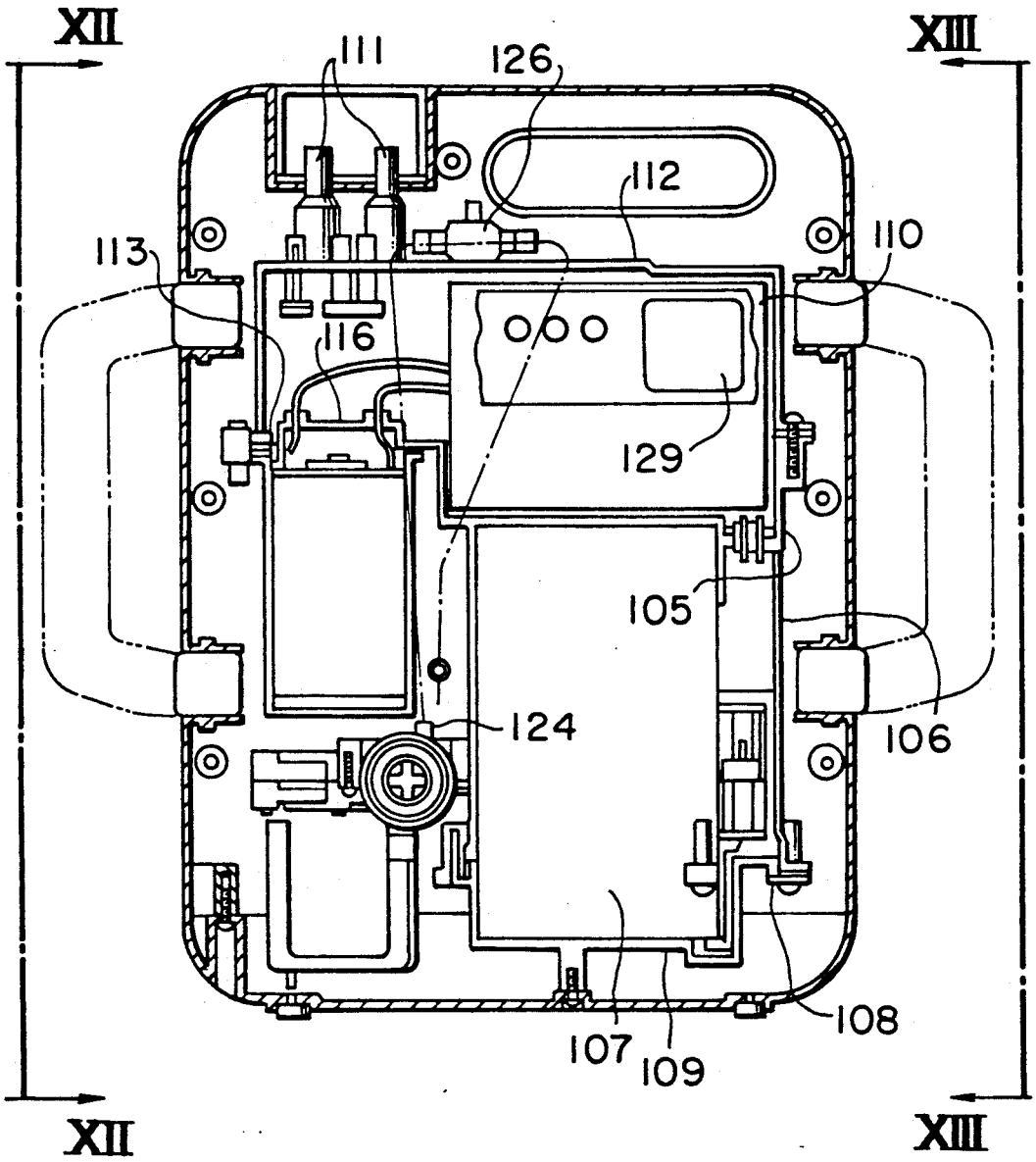
FIGS. 11-14, 15A-15D, and 16-17 show a third embodiment of the present invention, and more particularly.
Figure 12:
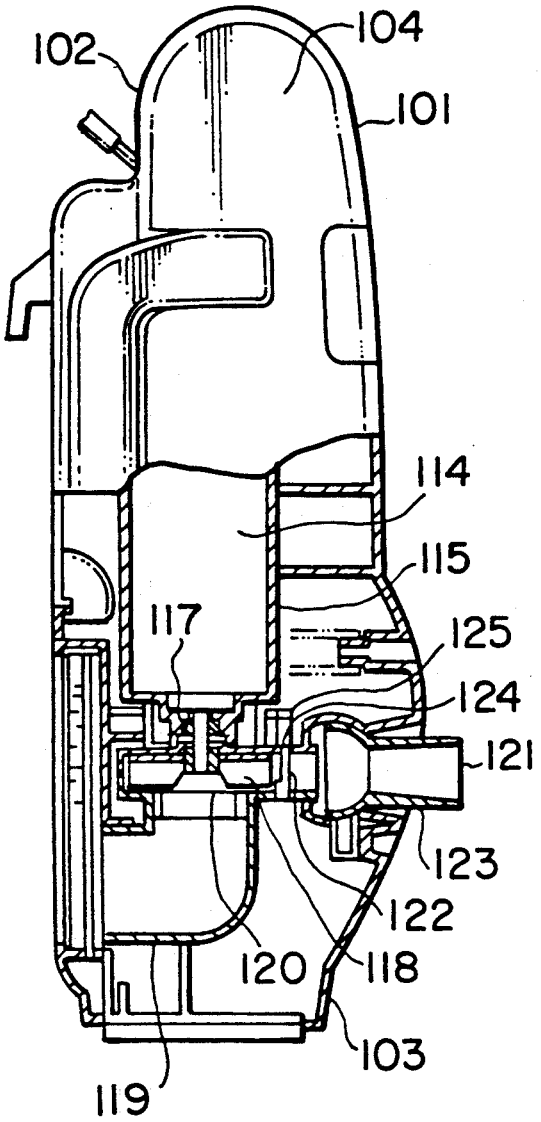
Figure 13:
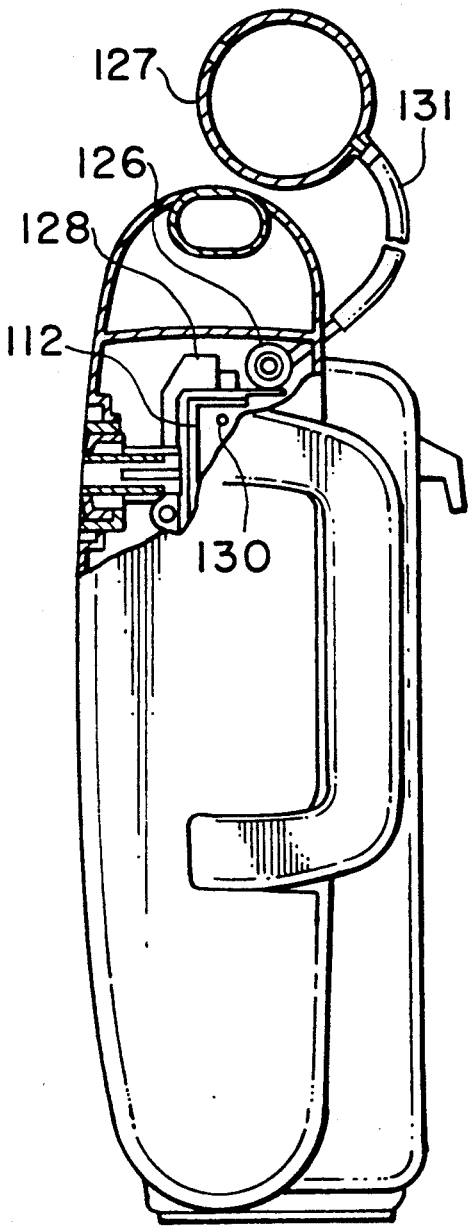
Figure 14:
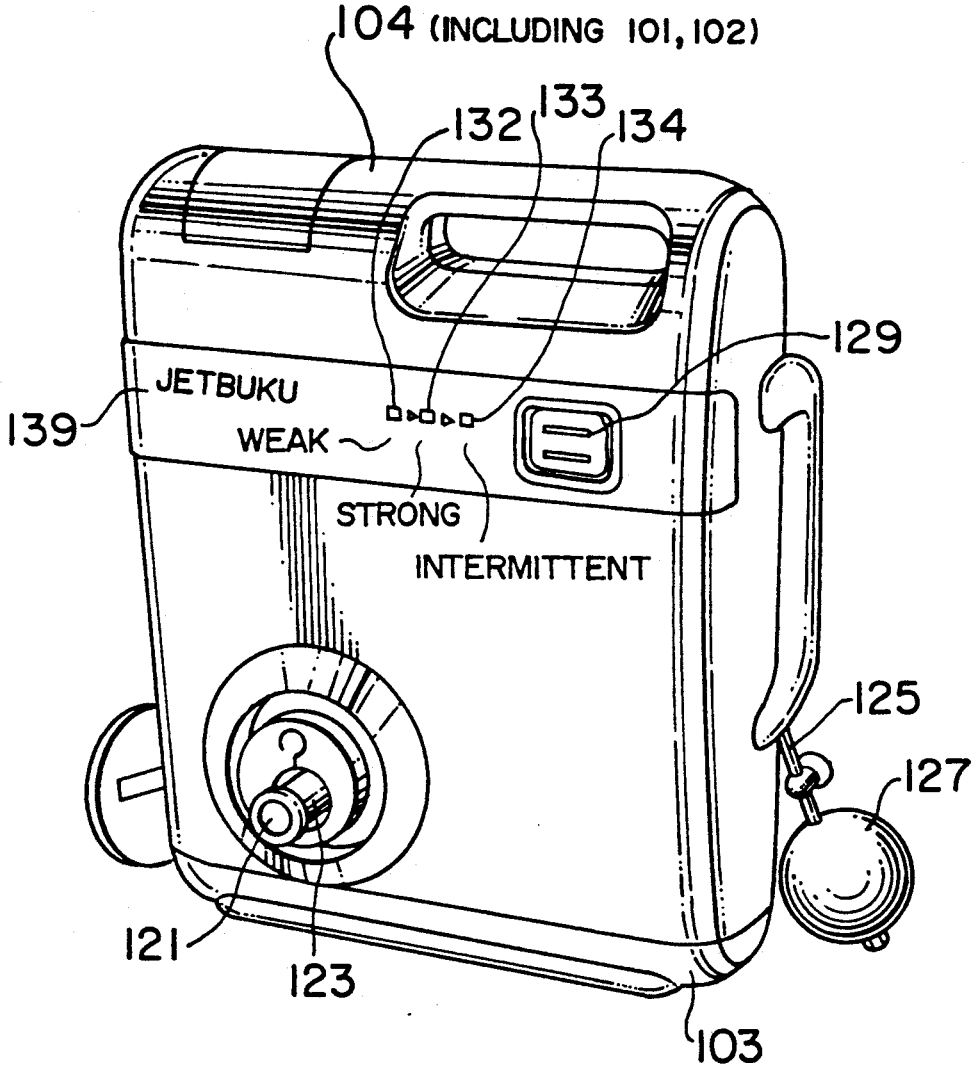

FIG. 11 is a sectional view showing the structure of the main body of the third embodiment of the present invention from the front thereof, FIG. 12 is a sectional view showing the main body from the side in the direction XII—XII shown in FIG. 11, and FIG. 13 is a sectional view showing the main body from the side in the direction XIII—XIII shown in FIG. 11. Further, FIG. 14 is a sketch drawing of the main body of the third embodiment of the present invention.

In FIG. 11 through FIG. 13, a battery 107 is housed in a lower chamber in an inner case 106 of upper and lower chambers wet-sealed by a lead wire packing 105 inside a main body case 104 consisting of a front case 101, a rear case 102 and a base 103. The battery 107 is wet-sealed by a rubber packing 108 and enclosed by a battery cover 109. A control circuit 110 is disposed in an upper chamber, and is wet-sealed and enclosed by means of a circuit cover 112 provided with terminals 111 for charging the battery 107 and a rubber packing 113. Furthermore, a motor case 115 provided with a motor 114 for a pump is fitted, and the inner case 106 is kept air-tight against the outside by means of a packing 116. Under a motor case 115, an impeller 118 which is wet-sealed by an oil seal 117 and rotated by a motor 114 for the pump is provided, and forms a centrifugal type pump portion along with a pump cover 120 provided with an air intake coupling 119. A bubble jet port 121 of the pump portion is composed of a nozzle 122, a diffuser 123 and an air intake port 124, and an air intake pipe 125, an air intake change-over valve 126 and an air intake ball 127 are installed at the air intake port 124 for introducing air from the outside. Further, a pushbutton 129 containing a magnet 128 is provided on the circuit cover 112, and operation (jet change-over) and suspension are performed by turning a reed switch 130 provided in the control circuit 110 ON and OFF. The present device is used in a bathtub, and the air intake ball 127 and an air intake pipe 131 are placed outside the bathtub, water and air are taken in through respective parts by operation of the pump, and water and air are mixed in the diffuser 123 and the bubble jet is discharged through the bubble jet port 121. Thus, the bubble jet gives a massage effect.

Figure 17:
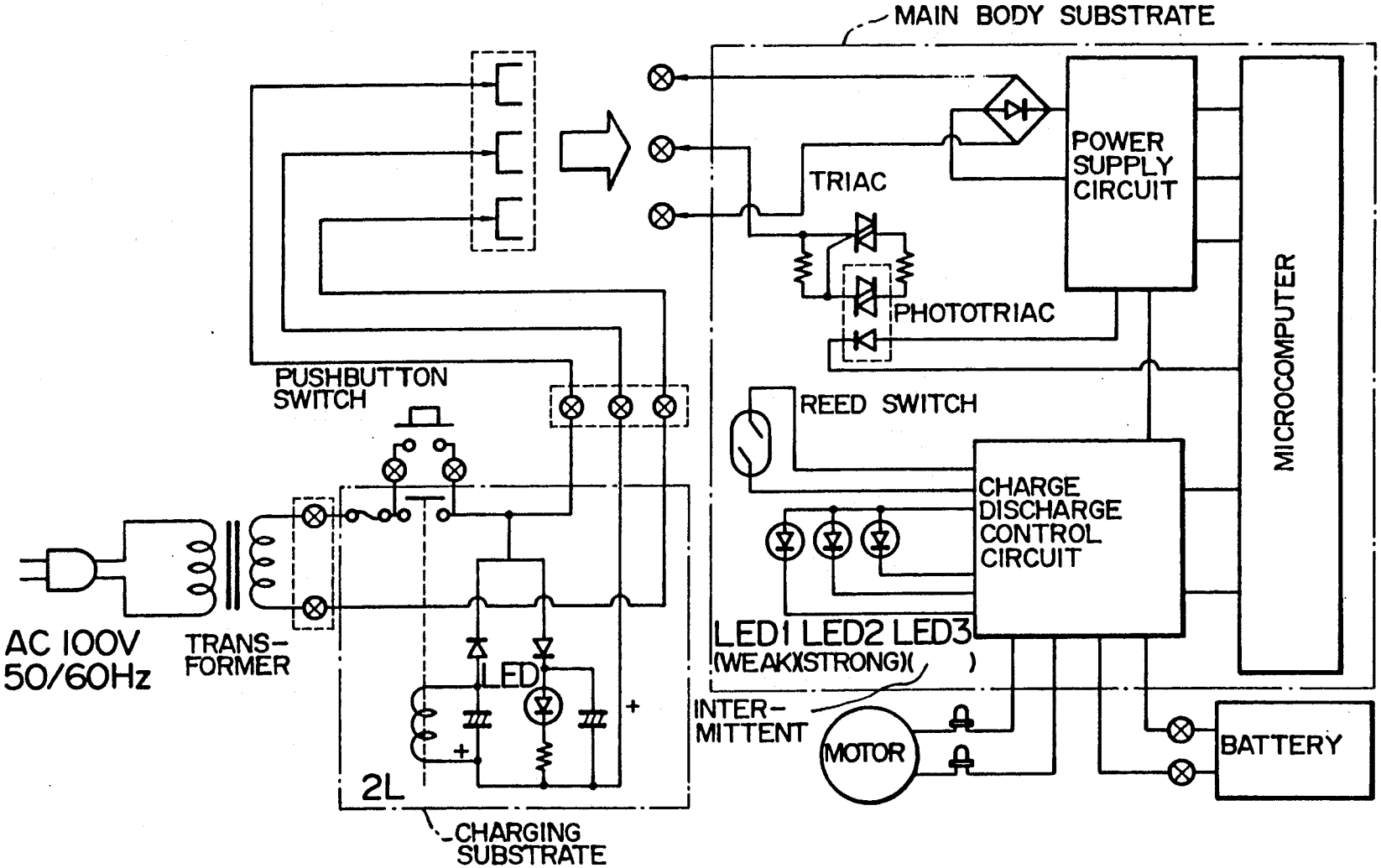

Discharge is controlled by the main body control circuit 110 shown in FIG. 17 so a to discharge three types of jets, weak, strong and intermittent, which can be selected with one pushbutton 129 successively in the order of weak →strong →intermittent (repetition of strong ⟷feeble). A system in which the jet is uninterrupted is adopted for the intermittent jet by repeating strong ⟷feeble jets. The relationship among the pushbutton 129, display lamps 132, 133 and 134, and the types of jets is as follows (FIG. 15A through FIG. 15D).

Figure 15A:
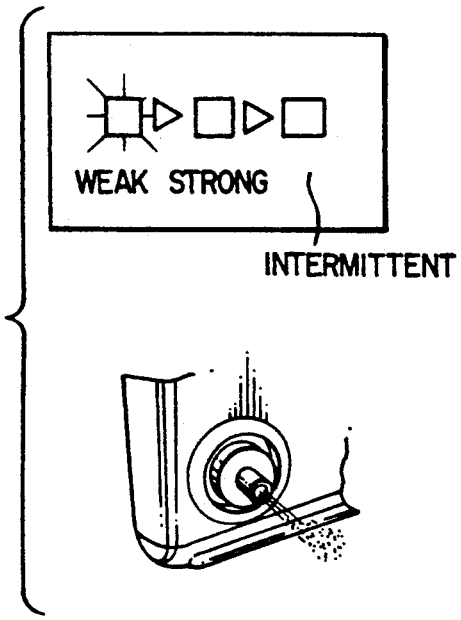
Figure 15B:
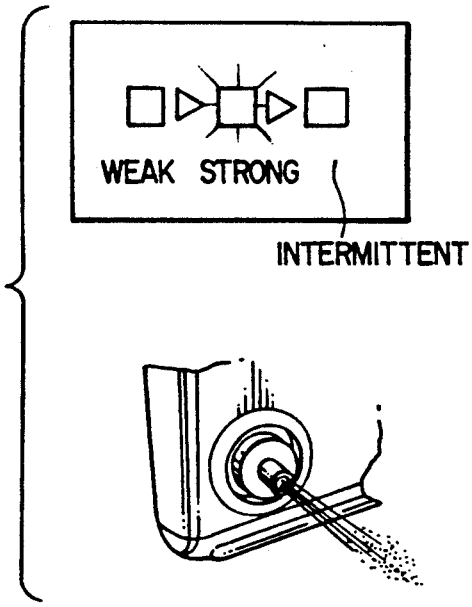
Figure 15C:
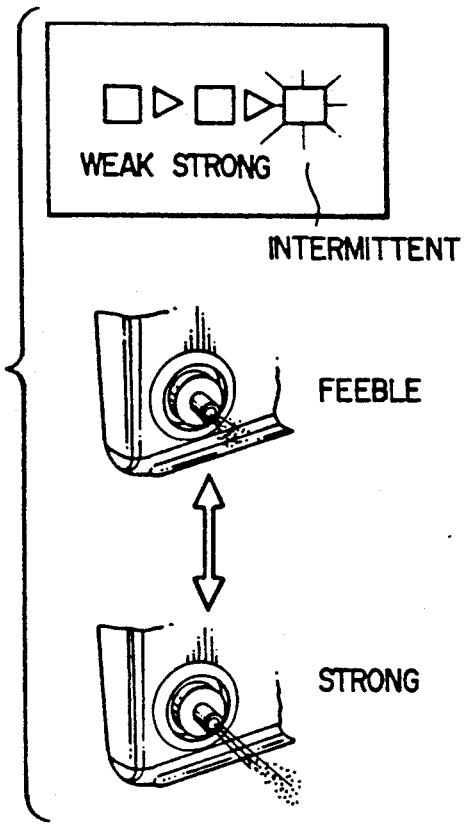
Figure 15D:
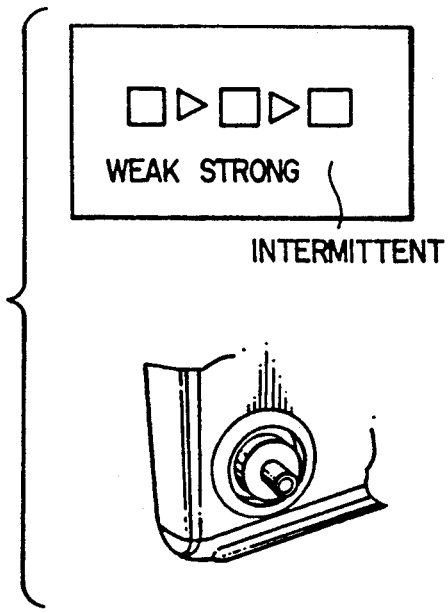

When the pushbutton 129 is pushed first, the display lamp 132 showing "weak" is turned ON, and a weak jet is discharged from the jet port 121 (FIG. 15A). Further, when the pushbutton 129 is pushed (a second time), the display lamp 133 showing "strong" is turned on, and a strong jet is discharged (FIG. 15B). Furthermore, when the pushbutton 129 is pushed (a third time), the display lamp 134 showing "intermittent" is turned on, and a jet repeating "strong" and "feeble" alternately is produced (FIG. 15C). Further, when the pushbutton 129 is pushed (a fourth time), the operation is stopped (FIG. 15D).

Figure 16:
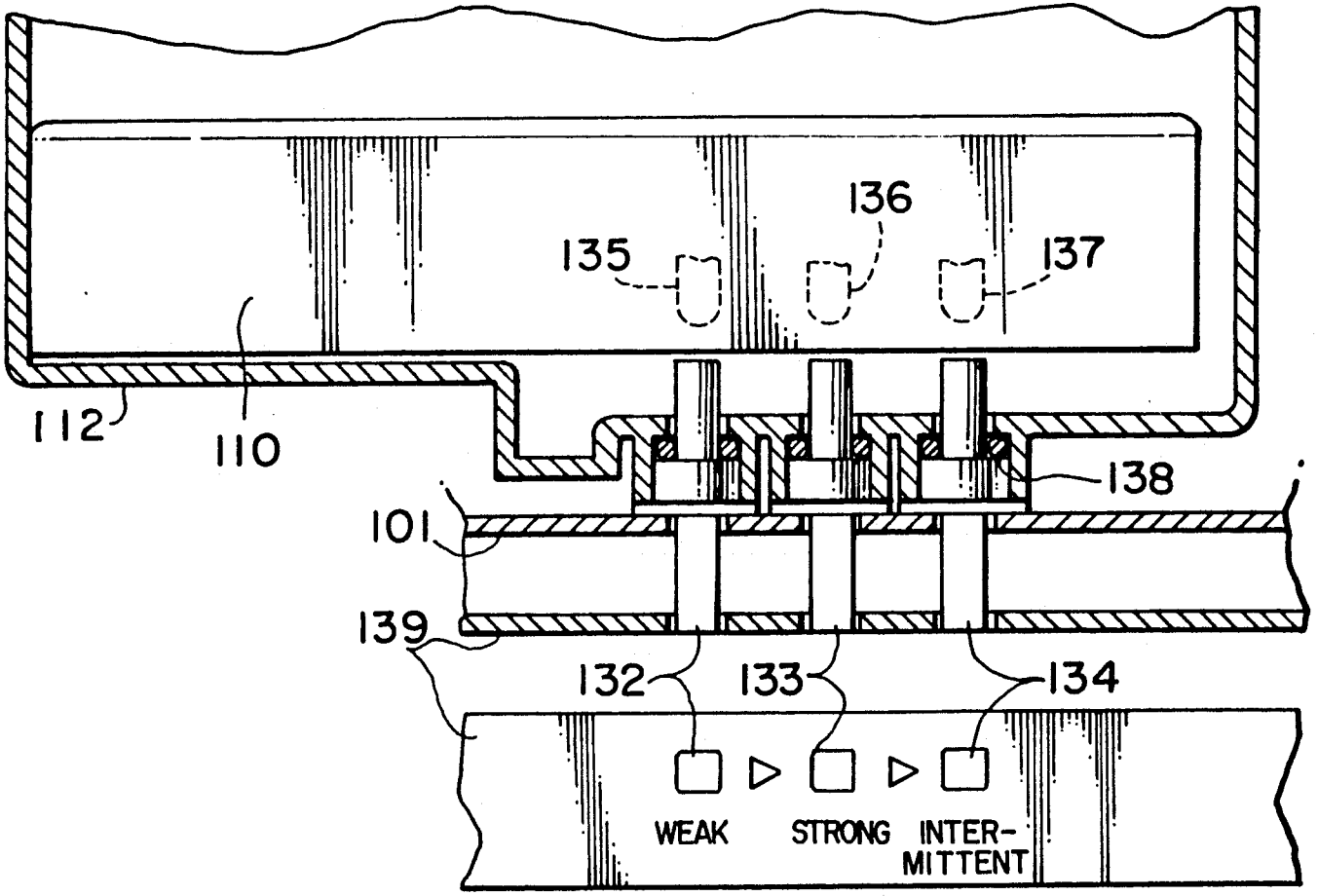

Further, FIG. 16 shows an embodiment in which the operating mode of a jet can be displayed. Optical guides 132, 133 and 134 which fulfill duties of display lamps on the outside surface are made non-contacting with display lamps in the control circuit 110, i.e., LEDs 135, 136 and 137, wet-sealed with the case (circuit cover) 112 which includes the control circuit 110 and an 0-ring 138 and held by the front case 101 and the circuit cover 112 so as to be fixed, thus making display possible. Reference numeral 139 denotes an ornamental board.

According to the present invention, it is possible to provide a shared display of a charging state and an operating state in a bubble massager. Accordingly, it is possible to reduce the area occupied by the display portion in a product, and it is also possible to provide a product which has a small number of components and is highly reliable.

Furthermore, since troubles may be displayed by using the display means having the same functions as the charging state and operating state display functions described above, it is easy to find out trouble locations.

Moreover, it is possible to select a jet in accordance with a part and a state (stiffness, myalgia and so on) of a body, and it is also possible to relieve a shock due to a sensible sudden change by starting from a weak jet. It is intended to relieve a stress and reduce a starting current at the time of starting the motor by repeating intermittent operation of strong ⟷feeble so that operation of the motor is not stopped.

Further, such a construction is formed as to include optical guides (display lamp on the outside surface) which are made non-contacting with display lamps (LEDs) on the control circuit and may be wet-sealed to a case containing the control circuit, thus making it possible to confirm the operating mode.

We claim:

1. A bubble massager comprising:
a nozzle;
an air intake port;
a diffuser connected to said nozzle and said air intake port;
pumping means for pumping water through said nozzle into said diffuser, thereby taking in air through said air intake port, mixing the air with the water in said diffuser and discharging the mixed air and water from said diffuser to produce a bubble jet;
a rechargeable storage battery for supplying electric power to said pumping means;
charging means for charging said storage battery;
charge display means for displaying a charging state of said storage battery when said charging means is charging said storage battery; and
operation display means for displaying an operating state of said bubble massager when said pumping means is operating;
wherein said charge display means and said operation display means use a same display unit.

2. A bubble massager according to claim 1, further comprising control means for controlling said pumping means to produce a bubble jet selected from a weak bubble jet, a strong bubble jet, and an intermittent bubble jet, said intermittent bubble jet being produced by alternately producing said weak bubble jet and said strong bubble jet.

3. A bubble massager according to claim 1, wherein said charging means increases a charging voltage supplied to said storage battery when an atmospheric temperature is low when said charging means is charging said storage battery.

4. A bubble massager according to claim 2, wherein said display unit includes an intermittent bubble jet display lamp, and wherein said operation display means causes said intermittent bubble jet display lamp to light continuously when said pumping means is producing said intermittent bubble jet and a voltage of said storage battery is above a predetermined voltage, and causes said intermittent bubble jet display lamp to flicker at a low speed when said pumping means is producing said intermittent bubble jet and the voltage of said storage battery is below the predetermined voltage.

5. A bubble massager comprising:
a nozzle;
an air intake port;
a diffuser connected to said nozzle and said air intake port;
pumping means for pumping water through said nozzle into said diffuser, thereby taking in air through said air intake port, mixing the air with the water in said diffuser and discharging the mixed air and water from said diffuser to produce a bubble jet;
a rechargeable storage battery for supplying electric power to said pumping means;
charging means for charging said storage battery;
charge display means for displaying a charging state of said storage battery when said charging means is charging said storage battery;
operation display means for displaying an operating state of said bubble massager when said pumping means is operating; and
trouble location display means for displaying trouble locations in said bubble massager;
wherein said charge display means, said operation display means, and said trouble location display means use a same display unit including at least one display lamp; and wherein said trouble location display unit causes at least one of said at least one display lamp to flicker at a high speed when trouble occurs in said bubble massager.

6. A bubble massager comprising:

a nozzle;

an air intake port;

a diffuser connected to said nozzle and said air intake port;

pumping means for pumping water through said nozzle into said diffuser, thereby taking in air through said air intake port, mixing the air with the water in said diffuser, and discharging the mixed air and water from said diffuser to produce a bubble jet; and control means for controlling said pumping means to produce a bubble jet selected from a weak bubble jet, a strong bubble jet, and an intermittent bubble jet;

wherein said control means includes a pushbutton switch disposed on a main body of said bubble massager, and wherein said control means controls said pumping means to successively produce said bubble jet beginning with the weak bubble jet, progressing to the strong bubble jet, and ending with the intermittent bubble jet when said pushbutton switch is successively pushed;

wherein said control means is disposed in a control means case and further includes LEDs for displaying information relating to operation of said bubble massager, and wherein said bubble massager further comprises:

optical guides for guiding light from said LEDs to an outside surface of said main body, thereby serving as display lamps on said main body, said optical guides being wet-sealed to said control means case using O-rings such that said optical guides do not contact said LEDs, said optical guides being held between a front case of said main body and said control means case.

* * * * *